US007936451B2

(12) United States Patent
Schneider et al.

(10) Patent No.: US 7,936,451 B2
(45) Date of Patent: May 3, 2011

(54) METHOD FOR MACHINING AND ESTIMATING AN OPTICAL LENS DESIGNED AS A SEMI-FINISHED PRODUCT

(75) Inventors: Gunter Schneider, Marburg (DE); Helwig Buchenauer, Dautphetal-Buchenau (DE); Stephan Huttenhuis, Marburg (DE)

(73) Assignee: Schneider GmbH & Co. KG, Steffenberg (DE)

( * ) Notice: Subject to any disclaimer, the term of this patent is extended or adjusted under 35 U.S.C. 154(b) by 0 days.

(21) Appl. No.: 12/592,929

(22) Filed: Dec. 4, 2009

(65) Prior Publication Data

US 2010/0165330 A1 Jul. 1, 2010

(30) Foreign Application Priority Data

Dec. 5, 2008 (DE) ..... 10 2008 060 589

(51) Int. Cl.
*G01B 9/00* (2006.01)

(52) U.S. Cl. ..... 356/124; 356/126

(58) Field of Classification Search ..... 356/124, 356/126; 382/108, 141
See application file for complete search history.

(56) References Cited

U.S. PATENT DOCUMENTS

| | | | | |
|---|---|---|---|---|
| 2006/0176491 | A1* | 8/2006 | Hall | 356/601 |
| 2008/0100850 | A1* | 5/2008 | Watson | 356/601 |
| 2009/0244525 | A1* | 10/2009 | Kanno et al. | 356/124 |

FOREIGN PATENT DOCUMENTS

| | | | |
|---|---|---|---|
| DE | 101 03 113 | A1 | 8/2002 |
| DE | 10 2004 020 419 | B3 | 10/2005 |
| DE | 20 2005 009 847 | U1 | 11/2005 |
| EP | 0 359 084 | B2 | 1/1998 |
| JP | 3829435 | | 10/2006 |

OTHER PUBLICATIONS

Grimm, Der Einsatz moderner Messmethoden zur Entwicklung und Fertigung von Brillenglasern, DOZ, Technologie, Dec. 20, 1984, pp. 41-47.

* cited by examiner

*Primary Examiner* — Roy Punnoose
(74) *Attorney, Agent, or Firm* — Hudak, Shunk & Farine Co. LPA

(57) ABSTRACT

The invention relates to a method for machining and estimating an optical lens which is designed as a semi-finished product, with a pre-finished form of a first side and a second side to be machined, in which a pre-specified form of a surface of the second side to be machined is estimated, wherein prior to estimating the pre-specified form of the surface of the second side, an actual form of the surface of the first side is measured using measuring means and is incorporated into the estimation of the pre-specified form of the surface of the second side.

9 Claims, 1 Drawing Sheet

METHOD FOR MACHINING AND ESTIMATING AN OPTICAL LENS DESIGNED AS A SEMI-FINISHED PRODUCT

FIELD OF THE INVENTION

The invention relates to a method for machining and estimating an optical lens designed as a semi-finished product, with a pre-finished form of a first side and a second side which is to be machined, in which for the purpose of obtaining the desired optical property of the finished lens, a pre-specified form of a surface of the second side to be machined is estimated as a processing stage, wherein prior to the estimation of the pre-specified form of the surface of the second side, an actual form of the surface of the first side is measured using measurement means, or is measured by a measuring instrument, and the actual form of the surface of the first side is incorporated in the estimation of the pre-specified form of the surface of the second side.

The first side or the second side can here be the front side or the rear side of the lens.

BACKGROUND OF THE INVENTION

A lens or spectacle lens generally has a front side and a rear side which are both bordered by an edge. The edge comprises an edge surface which is usually designed according to the frame. The optical effect of the front side and the optical effect of the rear side overlap and form the overall optical effect or optical property. The front side or the rear side here form the first side, while the rear side or the front side forms the opposite second side.

During the manufacture of lenses, in particular, spectacle lenses made of synthetic material, a semi-finished lens product is usually used, the first side of which is pre-finished, i.e. the form of the surface of the first side is produced according to a pre-specified form. In general, this is a cast moulded part, wherein the surface of the first side corresponds to a form of the form shell. In this case, the form shell comprises the pre-specified form to be formed. Due to the material properties of the synthetic material used, and due to the cooling process after injection, deviations occur between the pre-specified form of the tool and the actual form of the surface of the first side which is in reality attained.

Ultimately, the method permits the detection of faulty semi-finished parts which are erroneously fed into the process. A time-intensive and expensive machining of a faulty semi-finished product or blank is avoided, in particular, the relatively expensive processing stages such as milling, turning, polishing, hardening and coating.

The semi-finished product can be milled with a corresponding form of the surface of the first side. In this case, the deviations between the pre-specified surface and the actual surface which is produced in reality are generally lower, but also present.

These deviations have to date not been taken into account when estimating the pre-specified form of the surface of the second side of the lens to be manufactured. When estimating the pre-specified form of the surface of the second side, only the pre-specified form of the surface of the first side was taken into account.

A deflectometric stereo method for determining the local height and the local surface standard of reflective surfaces such as aspherical lenses is known from DE 10 2004 020 419 B3. Here, full reference is made to the principle relating to the measurement method, which for persons skilled in the art can be derived from DE 10 2004 020 419 B3.

SUMMARY OF THE INVENTION

The object of the invention is to provide a method for machining lenses with which the manufacture of lenses is guaranteed with the lowest possible tolerances.

The object is attained according to the invention by means of the fact that the semi-finished product is connected with the surface of the first side to a block piece, wherein the actual form of the surface of the first side is measured after being blocked on or connected. After blocking on, no further changes occur to the relative position between the block piece and the lens. To this extent, the determination of the form of the surface of the first side is advantageous at this point in time, since a deviation of the relative position between the block piece and the lens which occurs during blocking on is no longer possible.

Against this background, and by taking into account the actual geometry, or the current measured values of the actual form of the first side, when estimating the form of the second side of the lens, an extremely precise estimation of the pre-specified form of the second side is guaranteed.

The manufacture of individual prescription surfaces is becoming increasingly important. The manufacture of individual prescription surfaces entails greater complexity of the surfaces to be produced. Manufacturing errors become increasingly significant. Furthermore, the finished first side can deviate from the spherical form, whereby further tolerances for different curvature values would result. Taking into account the requirement for lenses which are as light as possible, as a result of the higher precision guaranteed according to the invention during estimation, despite the growing complexity, the thickness of the lens can be minimised and the required quality can be guaranteed.

Due to the increased competition on the market, a low-cost purchase of semi-finished products is necessary, for which the production tolerances are, however, higher. The stage according to the invention enables a reliable quality check prior to processing. This is also provided against the background that with semi-finished products from the Far East, the technical data supplied is extremely unreliable, and thus needs to be checked.

Here, it can be advantageously provided that an optical measuring means is used as a measuring means, wherein the actual form of the blocked on surface of the first side is held by the surface of the second side to be machined. The surface of the first side is at least partially covered by the block piece. Consequently, the measurement of the surface of the first side is only possible through the surface of the first side. Only one optical measuring means guarantees the measurement of the surface of the first side. Here, the optical influences on the measurement which are generated on the surface of the second side to be machined, or the reflections which occur there, are deducted from the estimation. This method is based on a multiple frequency analysis. Due to the fact that the signals or reflections from the surface of the first side and the signals from the surface of the second side have different frequencies, the signals from the first side can be separated by means of the multiple frequency analysis from those from the second side. Thus, it is possible to determine the actual form of the blocked on surface of the first side through the surface of the second side to be machined. The reflections from the surface of the first side are in this manner filtered out of the overall signal in the estimation.

For this purpose, it can also be advantageous when a known pre-specified form of the surface of the first side is compared with the determined actual form of the surface of the first side, and a deviation is determined. The deviation serves as the basis for the adjustment of the pre-specified form of the surface of the second side to the actual conditions of the first side. The pre-specified form of the surface of the second side can already be known on the basis of the pre-specified form of the surface of the first side. In this case, only an adjustment of the pre-specified form of the surface of the second side is required, on the basis of the ascertained deviations.

It can be of particular importance for the present invention when in addition to the measurement of the actual form of the surface of the first side, a relative position between the first side or the lens and the block piece is determined. In particular, the orientation of the lens relative to the block piece and the prism position of the surface can thus be determined.

In connection with the design and arrangement according to the invention, it can be advantageous when the relative position between the first side and the block piece is incorporated into the estimation of the pre-specified form of the surface of the second side. The second side to be manufactured can be adjusted to the existing alignment of the first side relative to the block piece in order that the thinnest and thus lightest glass possible can be manufactured. Furthermore, the position of the second side can be selected in such a manner that a rapid machining of the second side is guaranteed with the lowest tool stroke possible.

It can furthermore be advantageous when the anticipated machine deviations are incorporated into the estimation of the pre-specified form of the second side. This procedure is generally dependent on the method according to the invention, namely the determination of the actual form of the surface of the second side. With the increase in precision according to the invention, the inclusion of the machine deviations, i.e. of the position protocol data, becomes more significant.

It can also be advantageous when a deflectometric measuring method, preferably a stereo measuring method such as that described in DE 10 2004 020 419 B3, is used. This method has already been known for over four years, and has in the past delivered very good measuring results. Furthermore, the influences originating from the surface of the second side which is to be machined on the measurement of the surface of the first side or the reflections which occur can be easily deducted from the estimation.

Furthermore, it can be advantageous when the pre-specified form of the surface of the second side of the lens is machined using milling by means of a milling cutter and/or a turning tool and/or ground and/or polished. The method according to the invention can equally well be used for machining lenses made of synthetic material, as for mineral lenses.

BRIEF DESCRIPTION OF THE DRAWINGS

Further advantages and details of the invention are explained in the patent claims and in the description, and are illustrated in the figures, in which:

DETAILED DESCRIPTION OF THE INVENTION

Figure 1:
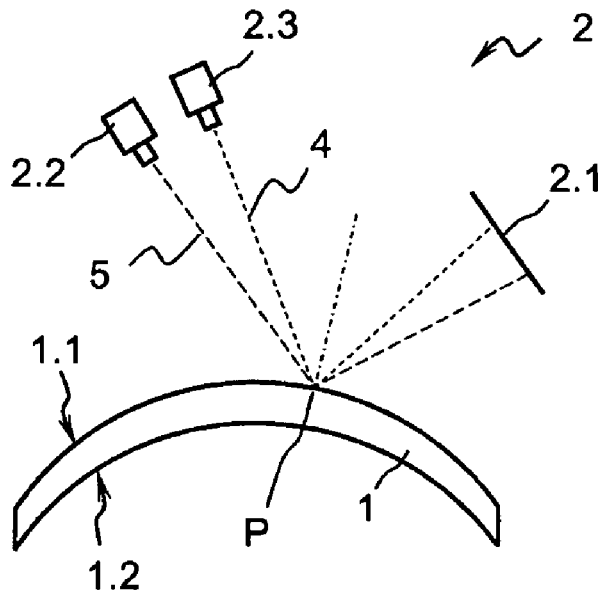
FIG. 1 shows a principle sketch of the measuring method

A lens 1 shown in FIG. 1 takes the form of a semi-finished product of a spectacle lens, and comprises a pre-finished first side 1.1. For the purpose of manufacturing a finished spectacle lens 1, an adjustment or machining of the second side 1.2 of the lens 1 is provided. When estimating a pre-specified form of the surface of the second lens 1.2, the real actual form of the surface of the first side 1.1 is measured using an optical measuring means 2. The optical measuring means 2 comprises a light source 2.1 for scattered light, by means of which scattered light is thrown in the form of defined patterns onto the surface of the first side 1.1 to be measured. The light reflects on the surface at a respective point P. The light reflected from this point P is recorded by a first camera 2.2 and a second camera 2.3 according to a respective light beam 4, 5. With the measuring method, the height and/or the surface standard of the surface of the first side 1.1 is determined, wherein the patterns recorded by the respective camera 2.2, 2.3 are evaluated. Here, from at least two observation directions according to the first and second camera 2.2, 2.3, the pattern reflected in the respective point P or an image of it, is recorded and from this, the respective surface standard is determined with the aid of the reflection law, wherein the actual height and the actual local surface standard are determined by the quantity of the points P which are treated in this manner, in which the potential surface standards concord.

Figure 2:
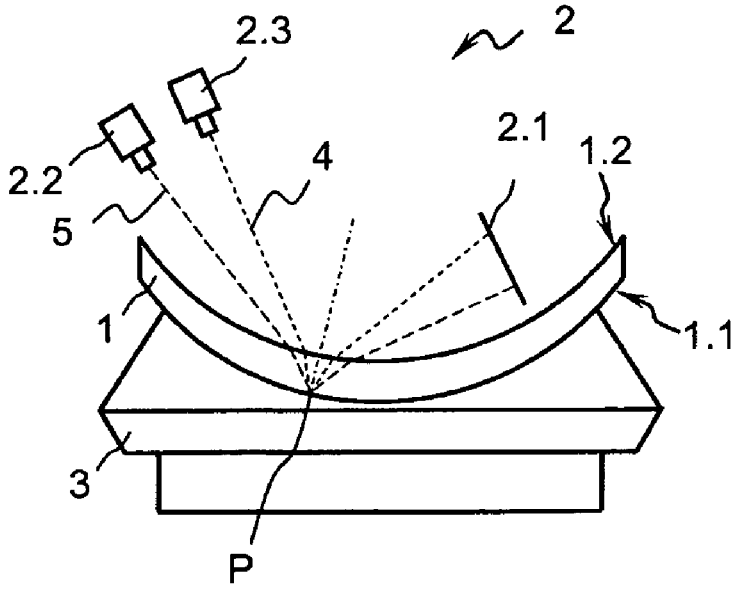
FIG. 2 shows a principle sketch of the measuring method with a blocked on lens.

In the exemplary embodiment shown in FIG. 2, the form of the surface of the first side 1.1 is also determined. In this case, the first side 1.1 is blocked onto a block piece 3 and thus, a part of the surface of the first side 1.1 is not accessible from outside. The respective light beam 4,5 which originates from the light source 2.1 impacts on the respective point P and is reflected from there, wherein a corresponding deflection occurs when exiting the lens 1 on the surface of the second side 1.2. When estimating the height and the surface standards in the point P, the known influence of the surface of the second side 1.2 on the optical path 4, 5, i.e. the deflection, is filtered out.

LIST OF REFERENCE NUMERALS

1 Lens, semi-finished product, spectacle lens
1.1 First side, surface
1.2 Second side, surface
2 Measuring means, optical measuring means
2.1 Light source
2.2 First camera
2.3 Second camera
3 Block piece
4 Optical path
5 Optical path
P Point

What is claimed is:

1. A method for machining and estimating an optical lens which is designed as a semi-finished product, with a pre-specified form of a first side and a second side which is to be machined, in which a pre-specified form of a surface of the second side to be machined is estimated, comprising the steps of:

a) prior to estimation of the pre-specified form of the surface of the second side, measuring an actual form of the surface of the first side using measuring means b) incorporating the actual form of the surface of the first side into the estimation of the pre-specified form of the surface of the second side and, c) connecting the semi-finished product with the surface of the first side with a block piece, wherein the actual form of the surface of the first side is measured after blocking on.

2. A method according to claim 1, wherein an optical measuring means is used as a measuring means, wherein the actual form of the blocked on surface of the first side is measured through the surface of the second side to be machined.

3. A method according to claim 1, wherein a known pre-specified form of the surface of the first side is compared with the determined actual form of the surface of the first side and a deviation is determined.

4. A method according to claim 3, wherein a deflectometric measuring method is used.

5. A method according to claim 1, wherein in addition to the measurement of the actual form of the surface of the first side, a relative position between the first side and the block piece is determined.

6. A method according to claim 5, wherein the relative position between the first side and the block piece is incorporated into the pre-specified form of the surface of the second side.

7. A method according to claim 1, wherein anticipated machine deviations are incorporated into the estimation of the pre-specified form of the surface of the second side.

8. A method according to claim 1, wherein the pre-specified form of the surface of the second side of the lens is machined using milling by a) a milling cutter, b) a turning tool, c) grinding, or d) polishing, or any combination of said a), b), c), and d).

9. The method according to claim 1 further including the step of machining a lens made of synthetic material or mineral glass.

* * * * *